United States Patent [19]

Camilleri

[11] Patent Number: 4,523,756

[45] Date of Patent: Jun. 18, 1985

[54] BALL KICKER

[76] Inventor: Thomas M. Camilleri, 277 Ave. W, Brooklyn, N.Y. 11223

[21] Appl. No.: 152,338

[22] Filed: May 22, 1980

Related U.S. Application Data

[63] Continuation-in-part of Ser. No. 958,717, Nov. 8, 1978, abandoned, which is a continuation-in-part of Ser. No. 769,410, Feb. 17, 1977, abandoned, which is a continuation-in-part of Ser. No. 622,234, Oct. 14, 1975, abandoned.

[51] Int. Cl.[3] ..... A63D 5/02

[52] U.S. Cl. ..... 273/49

[58] Field of Search ..... 273/43 R, 43 A, 49; 198/803

[56] References Cited

U.S. PATENT DOCUMENTS 3,101,195 8/1963 Szost ..... 273/49

3,297,322 1/1967 Ernst et al. ..... 273/43 R

OTHER PUBLICATIONS

"Physics of Tire Traction, Theory & Experiment" edited by Donald F. Hays & Alan L. Brow, publ. by Plenum Press, 1974, New York-London, pp. 223-227, copy in AU 161.

*Primary Examiner*—Anton O. Oechsle

*Attorney, Agent, or Firm*—D. J. Perrella

[57] ABSTRACT

A ball kicker for an automatic pin setting machine is formed of a semi-hard rubbery material having a plurality of vertical grooves.

9 Claims, 4 Drawing Figures

BALL KICKER

RELATED APPICATIONS

The present application is a continuation-in-part of my copending application Ser. No. 958,717 filed Nov. 8, 1978, now abandoned, which is a continuation-in-part of my copending application Ser. No. 769,410 filed Feb. 17, 1977, now abandoned, which is a continuation-in-part of my copending application Ser. No. 622,234 filed Oct. 14, 1975, now abandoned.

BACKGROUND OF THE INVENTION

The present invention relates to an automatic pin setting machine used in bowling alleys and, more particularly, to a ball kicker which forms part of the assembly for returning the ball to the bowler.

In one type of automatic pin setting machine, the ball, after it has been thrown by the bowler and reaches the pit area at the end of the lane, is guided to a ball return assembly. One component of this assembly is a ball kicker which moves the ball to the ball-return track. The ball kicker means is conventionally formed of a rubber cylindrical member or a rubber frusto-conical member having a cylindrical base which contacts the ball. Prior art ball kickers have a durometer hardness (Type A Shore Durometer) of about 60 or higher. The prior art ball kicker generally performs adequately when the bowling ball is dry. When conditioning oil has been applied to the lane, however, to produce a tight lane condition, i.e. to minimize excessive hooking, the ball picks up some of the oil. When this happens the oil reduces friction to such an extent that the ball kicker is unable to move the ball to the ball-return track. The result is that the ball just lies against the rotating ball kicker until the ball is manually moved onto the ball-return track. This result sometimes occurs even with a dry bowling ball in the case of light bowling balls. This condition delays the game and is a source of annoyance to the bowler as well as an expensive inconvenience to the management.

OBJECTS OF THE INVENTION

It is an object of the present invention to provide an improved ball kicker. A further object is to provide a ball kicker which will be effective for bowling balls which become coated with oil as well as dry bowling balls. These and other objects of the present invention will become apparent from the following description.

SUMMARY OF THE INVENTION

Figure 1:
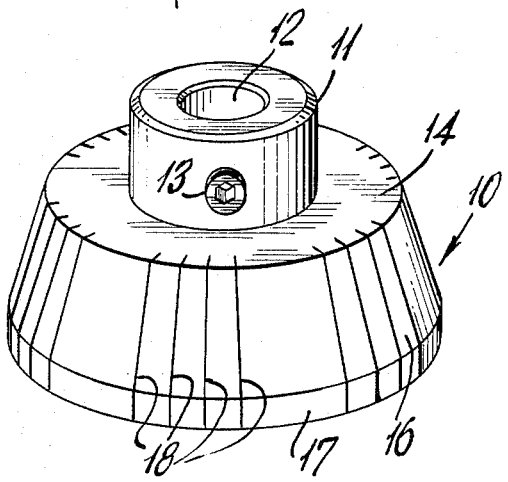
FIG. 1 is a perspective view of the ball kicker of the present invention.
Figure 2:
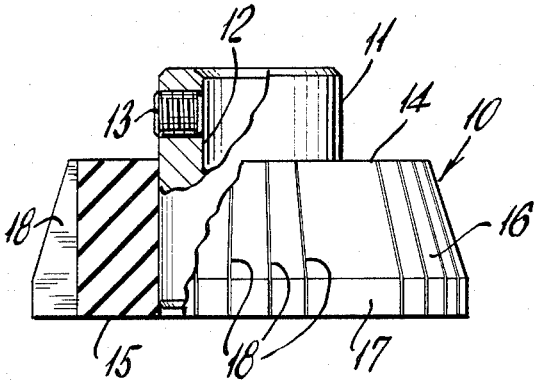
FIG. 2 is a side elevation.
Figure 3:
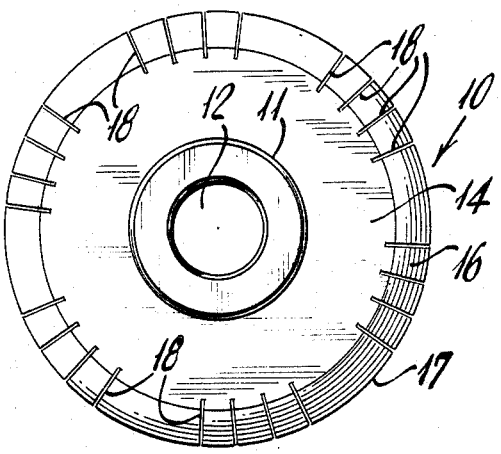
FIG. 3 is a top plan view.
Figure 4:
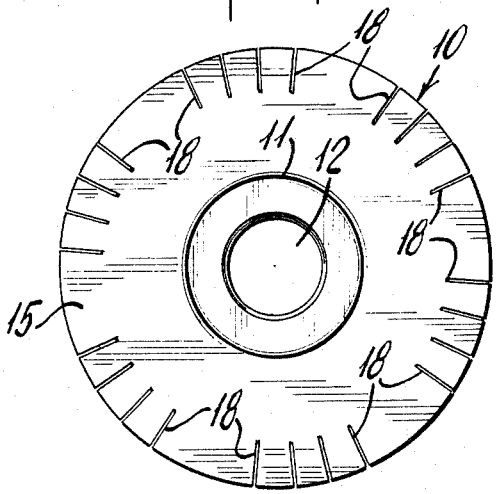
FIG. 4 is a bottom plan view.

A ball kicker for an automatic pin setting machine is formed of a semi-hard natural or synthetic rubber-like material having a durometer hardness of from about 35 to about 45 and a plurality of grooves.

DETAILED DESCRIPTION

As shown in the drawings, the ball kicker of the present invention consists of a body 10 shown in frusto-conical shape having a cylindrical base 17. It may equally, however, be cylindrical in shape. The cylindrical ball kicker is not illustrated as being obvious in view of the illustrated frusto-conical embodiment. Body 10 is fixedly attached to a cylindrical member 11. At least the outer surface of body 10 which contacts the bowling ball is made of a semi-hard natural or synthetic elastomeric material having a durometer hardness (Type A Shore Durometer) of from about 35 to about 45, preferably about 40, and the entire body 10 may be formed of an elastomeric material having such a durometer hardness. The ball kicker of the present invention may be formed, for example of natural rubber or its synthetic counterpart polyisoprene, neoprene, nitrile-butadiene rubber, butyl rubber, chlorinated butyl rubber, polyurethane and the like. Member 11 has a hollow core 12 adapted to receive a shaft (not shown) about which body 10 rotates. The upper portion of member 11 has a threaded opening 13 adapted to receive a set screw to fasten cylindrical member 11 to the shaft. The top 14 and bottom 15 of body 10 are substantially flat and circular. When body 10 is frusto-conical in shape, the top 14 has a smaller diameter than bottom 15. The cylindrical portion 17 of the conical sidewall 16 of body 10 is substantially perpendicular to the bottom 15. Body 10 is provided with a plurality of grooves 18 spaced apart from each other by a short distance, typically from about $\frac{1}{4}$ to about $\frac{1}{2}$ inch, preferably about $\frac{1}{4}$ inch. The grooves begin at about the perimeter of the top 14 and extend substantially vertically downwardly to the bottom 15. The grooves 18 extend inwardly about $\frac{1}{8}$ inch to about $\frac{1}{2}$ inch, preferably about $\frac{1}{4}$ inch from the perimeter of the bottom 15. The grooves may extend completely around the circumference of body 10 (not shown as obvious) but may also be intermittent as shown in the drawings to that an area containing several grooves is separated by a groove-free area from the adjacent area containing several grooves. The groove-free area is wider than the distance between adjacent grooves in an area containing several grooves.

In one embodiment of the invention each area containing a plurality of grooves alternates with an approximately equally sized area free of grooves. In another embodiment about half of the convex surface of the circumferential portion is provided with a plurality of substantially equally spaced areas each of which contains a plurality of substantially equally spaced grooves. In another embodiment about half of the convex surface of the circumferential portion is provided with a plurality of equally spaced groove containing areas covering symmetrically about half of the total convex surface of the circumferential portion. In another embodiment each area free of grooves is greater than the distance between adjacent grooves in an area containing a plurality of grooves.

The space between adjacent grooves 18 forms "fingers". Without being bound by any explanation for the effect of the ball kicker of the present invention, it is believed that when the outer surface of body 10 is contacted by the bowling ball, rather than merely being indented by the ball, the "fingers" are spread apart by the ball. As the ball kicker rotates, these "fingers" push the ball by a whipping effect rather than by frictional contact. The ball kicker of the present invention effectively moves the ball even when the ball is coated with oil or other lubricating substances.

The following experiment demonstrates the effectiveness of the ball kicker of the present invention in moving both dry and oil soaked bowling balls. The experiment was carried out on two adjacent AMF 82/70 pinspotters, one equipped with a conventional ball kicker, that is, a ball kicker having a convex surface without slits or grooves, and one equipped with a ball kicker according to the present invention.

I. Three bowling balls, a light ball weighing 8 pounds, a medium weight ball weighing 12 pounds and a heavy ball weighing 16 pounds, were rubbed over their entire surface with a clean oil-free cloth. The 16 pound ball was then rolled down the lane of the pinspotter equipped with a conventional ball kicker (without grooves). The ball kicker promptly moved the ball under the ball lift belt which raised the ball to the top of the ball return chute which returned the ball to the bowler's end of the lane. This procedure was repeated with the 12 pound and 8 pound balls with similar results.

The foregoing procedure was repeated on the pinspotter equipped with a ball kicker of the present invention having a durometer hardness of 40 with similar results, i.e., each ball was returned without delay to the bowler's end of the lane.

II. The foregoing procedure was repeated except that each of the balls was rubbed over its entire surface with an oil-soaked cloth to apply a coating of oil to the balls before rolling the balls down the lane of the pinspotter. Each ball in turn idled against the conventional ball kicker without being moved to the ball lift belt. The idling continued with each ball for several minutes until the ball was pushed manually under the ball lift belt which raised the ball to the top of the ball return chute which returned the ball to the bowler's end of the lane.

Each of the balls was again rubbed over its entire surface with an oil-soaked cloth to apply a coating of oil to the balls before rolling the balls down the lane of the pinspotter equipped with a ball kicker of the present invention having a durometer hardness of 40. This time the ball kicker promptly moved the ball under the ball lift belt which raised the ball to the top of the ball return chute which returned the ball to the bowler's end of the lane. The same procedure was repeated many times with the same positive results.

III. The procedure described in Section II above was repeated except that ball kickers with grooves according to the present invention but having durometer hardness of 30, 50 and 60 were substituted for the 40 durometer ball kicker. Each ball kicker moved the dry bowling balls satisfactorily. When the balls were rubbed with an oil-soaked cloth, however, the 30 and 60 durometer hardness ball kickers failed to move the balls to the ball lift belt, while the 50 durometer ball kicker performed better than the prior art ball kicker without grooves but not as well as the 40 durometer ball kicker of the present invention. The explanation for the failure of the 60 and 30 durometer ball kickers is believed due to the increased stiffness of the 60 durometer ball kicker and the increased softness of the 30 durometer ball kicker, both of which conditions prevent the development of the "whipping" action found with ball kickers having a durometer hardness of from about 35 to about 45.

What is claimed is:

1. In a ball kicker for an automatic pinspotter bowling machine mounted on a movable shaft, the improvement wherein the outer surface which contacts the bowling ball is formed of an elastomeric material having a durometer hardness of from about 35 to about 45 and wherein the outer surface is provided with a plurality of radial grooves adapted to move the bowling ball both when dry and when coated with oil.

2. A ball kicker according to claim 1 wherein the body is substantially cylindrical.

3. A ball kicker according to claim 1 wherein the body is substantially frusto-conical having a cylindrical base.

4. A ball kicker according to claim 1 wherein the grooves extend inwardly from about $\frac{1}{8}$ inch to about $\frac{1}{2}$ inch from the perimeter of the cylindrical base.

5. A ball kicker according to claim 4 wherein the grooves extend inwardly about $\frac{1}{4}$ inch.

6. A ball kicker according to claim 1 wherein the convex surface of the circumferential portion has from about 24 to about 36 grooves.

7. A ball kicker according to claim 4 having a durometer hardness of about 40 and containing about 36 grooves.

8. A ball kicker according to claim 7 wherein the grooves extend inwardly from about $\frac{1}{8}$ inch to about $\frac{1}{2}$ inch from the perimeter of the cylindrical base.

9. A ball kicker according to claim 8 wherein the grooves extend inwardly about $\frac{1}{4}$ inch.

* * * * *